US011067259B2

(12) United States Patent
Schmuckle et al.

(10) Patent No.: US 11,067,259 B2
(45) Date of Patent: Jul. 20, 2021

(54) OUTDOOR LIGHT FIXTURE

(71) Applicant: Hunter Industries, Inc., San Marcos, CA (US)

(72) Inventors: Darrin I. Schmuckle, Vista, CA (US); Adam Zeman, Del Mar, CA (US); Sergio Corona, Upland, CA (US)

(73) Assignee: Hunter Industries, Inc., San Marcos, CA (US)

( * ) Notice: Subject to any disclaimer, the term of this patent is extended or adjusted under 35 U.S.C. 154(b) by 64 days.

(21) Appl. No.: 16/145,088

(22) Filed: Sep. 27, 2018

(65) Prior Publication Data

US 2020/0103099 A1 Apr. 2, 2020

(51) Int. Cl.

| | |
|---|---|
| ***F21V 19/04*** | (2006.01) |
| ***F21V 15/01*** | (2006.01) |
| ***F21V 23/00*** | (2015.01) |
| ***F21V 31/00*** | (2006.01) |
| ***F21V 19/00*** | (2006.01) |
| ***F21V 29/70*** | (2015.01) |
| *F21Y 115/10* | (2016.01) |
| *F21W 111/027* | (2006.01) |
| *F21W 131/10* | (2006.01) |

(52) U.S. Cl.

CPC ..... *F21V 19/04* (2013.01); *F21V 15/01* (2013.01); *F21V 19/001* (2013.01); *F21V 23/001* (2013.01); *F21V 23/005* (2013.01); *F21V 29/70* (2015.01); *F21V 31/005* (2013.01); *F21W 2111/027* (2013.01); *F21W 2131/10* (2013.01); *F21Y 2115/10* (2016.08)

(58) Field of Classification Search

CPC ..... F21V 19/04; F21V 15/01; F21V 23/001; F21V 31/005; F21V 19/001; F21V 29/70; F21V 23/005; F21Y 2115/10; F21W 2111/027; F21W 2131/10

USPC ..... 362/146, 147, 222, 217.05, 249.02, 366

See application file for complete search history.

(56) References Cited

U.S. PATENT DOCUMENTS

| | | | | |
|---|---|---|---|---|
| 8,390,207 | B2 * | 3/2013 | Dowling | H05B 45/37 315/186 |
| 8,419,205 | B1 * | 4/2013 | Schmuckle | F21V 33/006 362/146 |
| 8,672,502 | B2 * | 3/2014 | Hartman | F21S 8/036 362/145 |

(Continued)

*Primary Examiner* — Tracie Y Green

(74) *Attorney, Agent, or Firm* — Knobbe Martens Olson & Bear, LLP

(57) ABSTRACT

Disclosed is an outdoor light fixture assembly having a housing, a contact block, and a user serviceable light module. The housing has a first opening for receiving the contact block and a second opening for receiving the user serviceable light module. The contact block has at least one contact and a power wire. The contact block can be disposed relative to the first opening so that the at least one contact is accessible from inside the housing. The user serviceable light module light module is sized and shaped to transition between a connected position and a released position relative to the housing. The user serviceable light module has a cover and a circuit board supporting one or more light emitting diodes and having at least one contact pin. The light emitting diodes are arranged relative to the circuit board to emit light in a direction towards the second opening when the user serviceable light module is in the connected position.

29 Claims, 11 Drawing Sheets

(56) References Cited

U.S. PATENT DOCUMENTS

| | | | | |
|---|---|---|---|---|
| 8,714,767 | B2 * | 5/2014 | Sears | E04F 11/104 362/146 |
| 8,783,916 | B2 * | 7/2014 | Tyson | F21S 8/022 362/366 |
| 9,213,361 | B1 * | 12/2015 | Urban | G06F 1/206 |
| 2010/0284173 | A1 * | 11/2010 | Verjans | E04F 13/08 362/145 |
| 2011/0063849 | A1 * | 3/2011 | Alexander | F21V 19/001 362/294 |
| 2012/0051068 | A1 * | 3/2012 | Pelton | F21V 14/06 362/373 |
| 2012/0236547 | A1 * | 9/2012 | Hartman | B66B 23/225 362/152 |
| 2013/0063946 | A1 * | 3/2013 | Preuschl | F21K 9/20 362/249.02 |
| 2014/0313775 | A1 * | 10/2014 | Myers | G02B 6/0051 362/612 |
| 2019/0101256 | A1 * | 4/2019 | Hartman | F21V 23/06 |

* cited by examiner

OUTDOOR LIGHT FIXTURE

BACKGROUND

Field

This invention relates to lights, and more particularly, relates to outdoor light fixture assemblies.

Description of the Related Art

Outdoor lighting is frequently used in gardens, yards, landscapes, walkways, steps, and building exteriors to provide visibility, security, and/or aesthetics. Common types of outdoor light fixtures include path lights, wall lights, tree lights, deck lights, well lights, step lights, and rope lights.

SUMMARY

In a first aspect, an outdoor light fixture assembly configured to be supported by a step or cap via a mounting plate includes a housing configured to be support by the mounting plate is provided. The light fixture assembly includes a housing forming a receptacle having at least a first opening and a second opening. The outdoor light fixture assembly also includes a contact block having at least one contact and a power wire, the contact block being sized and shaped to be disposed relative to the first opening such that the at least one contact is accessible from inside the housing and at least a portion of the power wire is disposed outside the housing. The power wire is configured to releasably and electrically connect with a source of electric power. The light fixture assembly further includes a user serviceable light module being sized and shaped to transition between a connected position and a released position relative to the housing and allowing a user to disassemble the user serviceable light module and service individual components. The user serviceable light module is disposed in the receptacle and covers the second opening so as to prevent water from entering the housing through the second opening when in the connected position. The user serviceable light module has a cover and a circuit board supporting one or more light emitting diodes. The circuit board has at least one contact pin. The one or more light emitting diodes are arranged relative to the circuit board to emit light in a direction towards the second opening of the housing when the user serviceable light module is in the connected position.

In a second aspect, an outdoor light fixture assembly is provided. The outdoor light fixture assembly includes a housing forming a receptacle having at least a first opening and a second opening. The outdoor light fixture assembly also includes a contact block having at least one contact and a power wire, the contact block being sized and shaped to be disposed in the first opening such that the at least one contact is accessible from inside the housing and at least a portion of the power wire is disposed outside the housing. The power wire is configured to releasably and electrically connect with a source of electric power. The outdoor light fixture assembly also includes a circuit board disposed in the receptacle supporting one or more light emitting diodes and having at least one contact pin. The outdoor light fixture assembly further includes a cover being sized and shaped to transition between a secured position and an unsecured position relative to the housing. The cover is disposed on the receptacle and covers the second opening so as to prevent water from entering the housing through the second opening when in the secured position. The cover is spaced further from the second opening when in the unsecured position than when in the secured position. The cover has a contact support disposed so as to limit movement of the at least one contact pin in a direction away from the at least one contact and relative to the circuit board by contacting the at least one contact pin when the cover is moved from the unsecured position to the secured position bringing the at least one contact pin into electrical contact with the at least one contact.

In a third aspect, an outdoor light fixture assembly is provided. The outdoor light fixture assembly includes a housing forming a receptacle having at least a first opening and a second opening. The outdoor light fixture assembly also includes a contact block having at least one contact disposed in the receptacle. The outdoor light fixture assembly further includes a circuit board disposed in the receptacle and having at least one contact pin. The at least one contact pin extends from the circuit board and along a longitudinal axis of the at least one contact pin. The at least one contact pin transitions from a non-electrically connected state to an electrically connected state with the at least one contact by movement of the at least one contact pin in a direction that is perpendicular to the longitudinal axis.

BRIEF DESCRIPTION OF THE DRAWINGS

The features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will now be described with additional specificity and detail through use of the accompanying drawings.

DETAILED DESCRIPTION

The following detailed description is directed to certain specific embodiments. The invention(s) disclosed herein, however, can be embodied in a multitude of different ways as defined and covered by the claims. In this description, reference is made to the drawings, wherein like parts are designated with like numerals throughout. The features, aspects and advantages of the present invention will now be described with reference to the drawings of several embodiments that are intended to be within the scope of the development herein disclosed. These and other embodiments will become readily apparent to those skilled in the art from the following detailed description of the embodiments having reference to the attached figures, the invention not being limited to any particular embodiment(s) herein disclosed.

Figure 1:
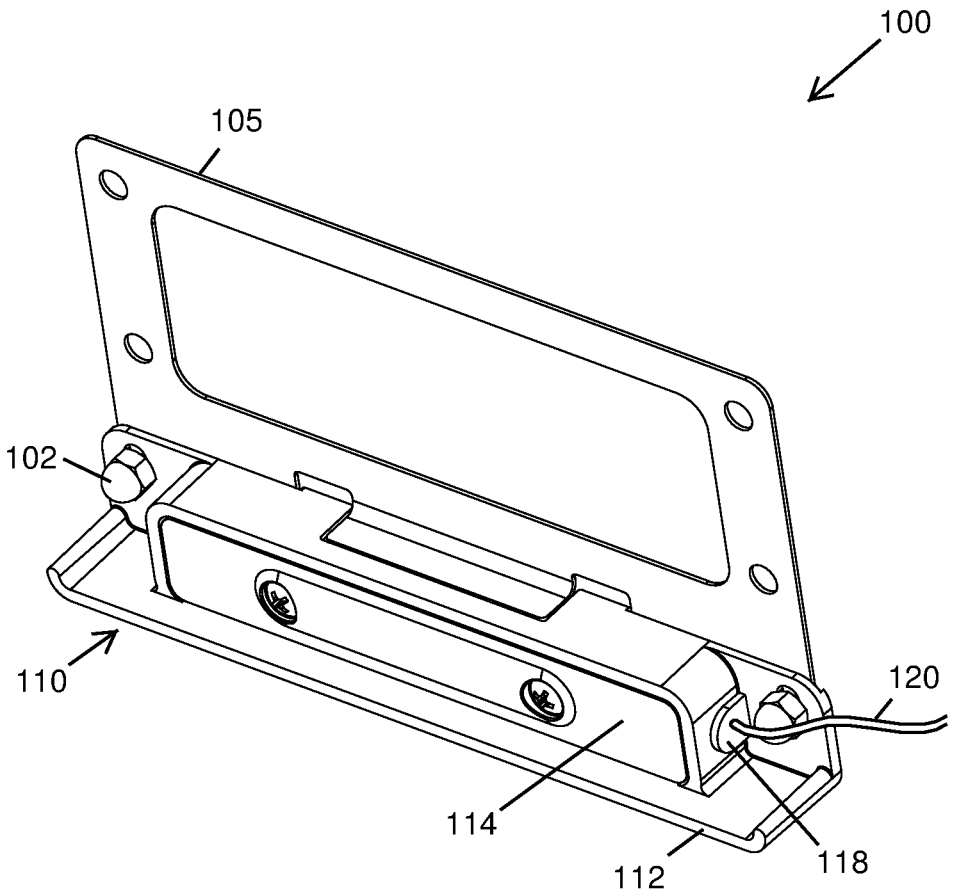
FIG. 1 is a perspective view of a light assembly according to a preferred embodiment of the present invention.

FIG. 1 illustrates an embodiment of a light assembly 100. The light assembly 100 can be secured within a light installation to emit light towards a desired area or surface. In certain embodiments, the light assembly 100 can include a mounting plate 105 and a light fixture assembly 110.

The light fixture assembly 110 can be configured to emit light in one or more directions exterior to the light fixture assembly 110. In certain embodiments, the light fixture assembly 110 can include a housing 112 and a light module 114. In certain embodiments, the light module 114 can be releasably secured within the housing 112. In certain embodiments, the light module 114 is user serviceable by allowing a user to service individual components of the light module 114. In certain embodiments, the light module 114 can be configured to emit light in one or more directions exterior to the housing 112.

In certain embodiments, the housing 112 can be formed of one or more plastics. In certain embodiments, the housing 112 can be formed of one or more metals. In certain embodiments, the housing 112 can be created with a 3D printer. In certain embodiments, the housing 112 can be formed of cast aluminum. In certain embodiments, the housing 112 can be formed of cast brass.

In certain embodiments, the light fixture assembly 110 can be coupled to the mounting plate 105. In certain embodiments, the housing 112 can be supported by the mounting plate 105 when the light fixture assembly 110 is coupled to the mounting plate 105. In certain embodiments, the housing 112 can be coupled to the mounting plate 105.

In certain embodiments, the light assembly 100 can include one or more fasteners 102. In certain embodiments, the light fixture assembly 110 can be releasably secured to the mounting plate 105 by the one or more fasteners 102. In certain embodiments, the fasteners 102 can include screws, bolts, nuts, or any other suitable fasteners. In certain embodiments, the light fixture assembly 110 can be supported in an installation via the mounting plate 105. For example, in certain embodiments, the light fixture assembly 110 can be supported by a step or a cap via the mounting plate 105.

In certain embodiments, the light fixture assembly 110 can include a contact block 118 having a power wire 120. In certain embodiments, the power wire 120 is configured to releasably and electrically connect with a source of electrical power. In certain embodiments, the contact block 118 is configured to transfer power from the power wire 120 to the light module 114.

Figure 2:
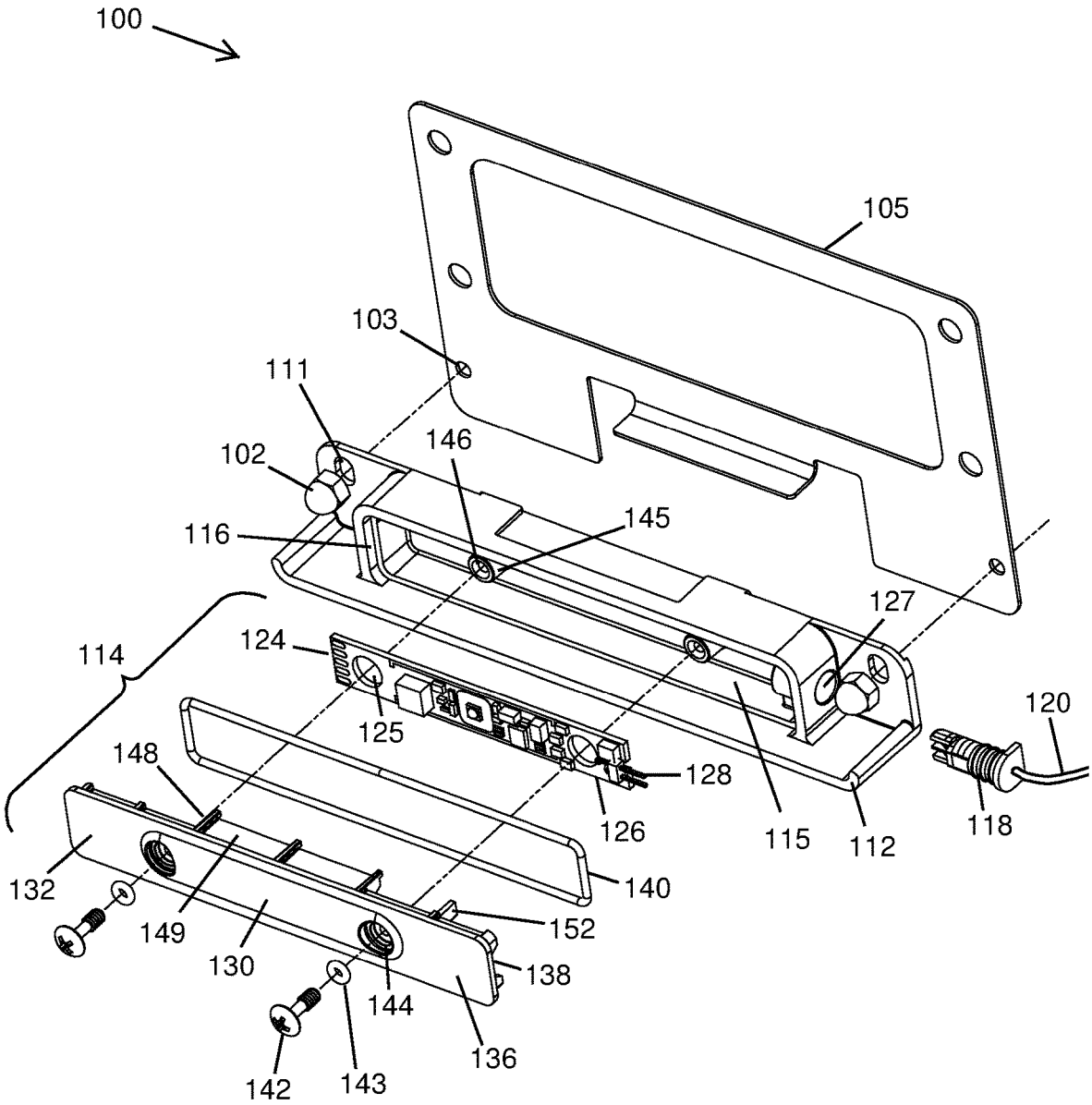
FIG. 2 is an exploded view of the light assembly of FIG. 1.

FIG. 2 illustrates an exploded view of an embodiment of the light assembly 100. As is illustrated in FIG. 2 and further explained with respect to FIGS. 14-16, one or more individual components of the light module 114 can be disassembled and reassembled by a user servicing the light module 114. In this way, the user can remove the light module 114 from the housing 112 and then subsequently disassemble the light module 114 to remove, replace, and/or add one or more individual components from/to the light module 114.

As will be further explained in connection with FIGS. 14-16, the user can disassemble an embodiment of the light module 114 that has a first combination of one or more components and then reassemble that same light module 114 using a second combination of one or more components. For example, the second combination can generally be the same as the first combination except that one or more individual components of the first combination have been switched out for similar components but having different optical characteristics such as color. In another example, the second combination of the one or more components includes at least one additional component not found in the first combination. In another example, the second combination of the one or more components includes fewer components than found in the first combination.

Once the service is complete by the user selecting and assembling the desired one or more individual components into the light module 114, the user then inserts the assembled light module 114 into the housing 112 as an assembly. In this way, the user is able to service the light module 114 and service individual components of the light module 114.

As shown in FIG. 2, the mounting plate 105 can include a plurality of apertures 103 for receiving the fasteners 102. In certain embodiments in which the fasteners 102 are nuts, the apertures 103 can receive complementary fasteners configured to secure to the fasteners 102. In some embodiments, a self-clinching stud can be installed in the aperture 103. The housing 112 can include a plurality of apertures 111 for receiving the fasteners 102. In certain embodiments in which the fasteners 102 are nuts, the apertures 111 can receive complementary fasteners configured to secure to the fasteners 102. The apertures 111 can be configured to align with the apertures 103 when the housing 112 is secured to the mounting plate 105 to allow the fasteners 102 to extend through both the apertures 103 and 111.

As shown in FIG. 2, the housing 112 can form a receptacle 115. In certain embodiments, the receptacle 115 can be configured to receive the light module 114. In certain embodiments, the light module 114 can be sized, shaped, and/or otherwise configured to transition between a connected position and a released position relative to the housing 112. In certain embodiments, the light module 114 is configured to transition between the connected and released positions without the use of tools.

In certain embodiments, the receptacle 115 includes an opening 116 configured to receive the light module 114. In certain embodiments, the light module 114 can be sized, shaped, and/or otherwise configured to be received in the opening 116. In certain embodiments, the light module 114 can be disposed in the receptacle 115 and can cover the opening 116 so as to inhibit or prevent water or other weather from entering the housing 112 through the opening 116 when in the connected position.

In certain embodiments, the receptacle 115 can be configured to receive the contact block 118. In certain embodiments, the receptacle 115 includes an opening 127 configured to receive the contact block 118. In certain embodiments, the contact block can include one or more contacts 122.

In certain embodiments, the receptacle 115 can receive the contact block 118 such that the one or more contacts 122 are accessible from inside the housing 112. In certain embodiments, the contact block 118 is sized, shaped, or otherwise configured such that the one or more contacts 122 are accessible from inside the housing 112 when the contact block 118 is received within the receptacle 115. In certain embodiments, when the contact block 118 is received within the receptacle 115, the one or more contacts 122 can be sized, shaped, positioned, or otherwise configured to engage one or more pins 128 of the light module 114.

In certain embodiments, the housing 112 can receive the contact block 118 such that the power wire 120 is disposed outside of the housing 112. In certain embodiments, the contact block 118 is sized, shaped, or otherwise configured such that the power wire 120 is disposed outside of the housing 112 when the contact block 118 is received within the receptacle 115.

Figure 2A:
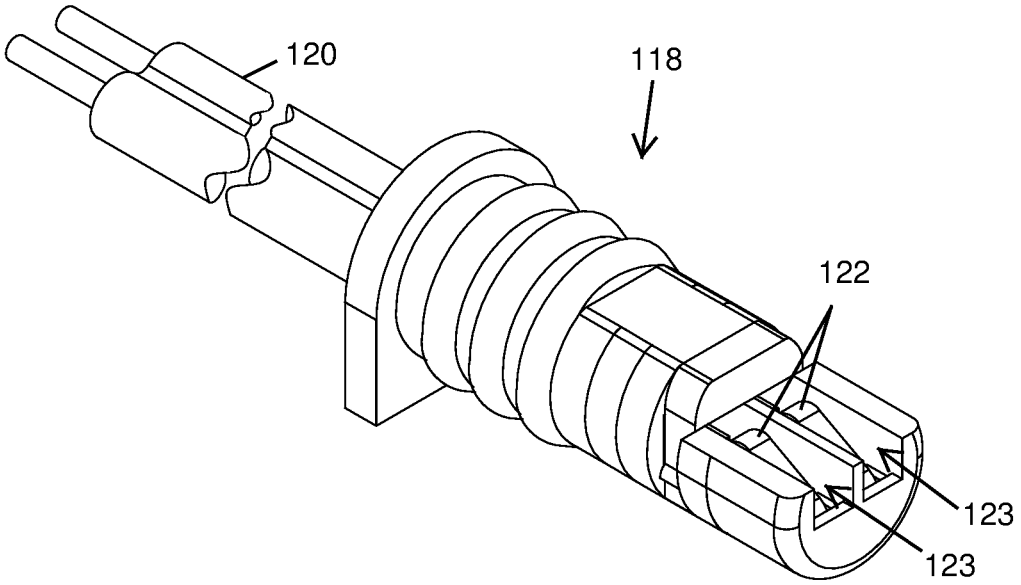
FIG. 2A is a perspective view of the contact block from FIG. 2.
Figure 2B:
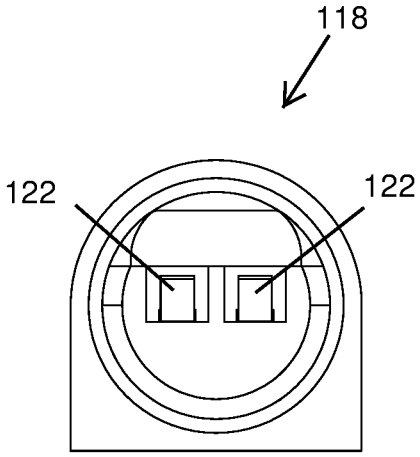
FIG. 2B is an end view of the contact block from FIG. 2A.

FIG. 2A is a perspective view of the contact block 118 from FIG. 2. FIG. 2B is an end view of the contact block 118 from FIG. 2A. In certain embodiments, the contact block 118 includes a single power wire 120. In other embodiments, a plurality of power wires 120 are employed. For example, in certain embodiments, the contact block 118 can include two, three, four, or any other suitable number of power wires 120.

In certain embodiments, a plurality of power wires 120 are bonded or otherwise bound together in a single cable. In certain embodiments a plurality of power wires 120 may be bonded together. In certain embodiments, the power wire 120 can be an insulated wire having an insulating jacket. In certain embodiments, the power wire 120 is a plurality of insulated power wires with their insulating jackets bonded together. In certain embodiments, the insulated wires are bonded together to form a zip-cord.

In certain embodiments, the contact block 118 includes one or more channels 123. The embodiment of the contact block 118 illustrated in FIGS. 2A and 2B includes two channels 123. The one or more contacts 122 can be sized, shaped, positioned, or otherwise configured within the one or more channels 123 to engage the one or more pins 128 of the light module 114. The one or more contacts 122 can include two, three, four, or any other suitable number of contacts. In certain embodiments, the one or more contacts 122 are spring contacts. In certain embodiments, the one or more contacts 122 are coiled wires. In the embodiment illustrated in FIGS. 2A and 2B, the one or more contacts 122 are leaf springs. In certain embodiments, the one or more contacts 122 are gold plated leaf springs. In certain embodiments, the one or more contacts 122 are two gold plated leaf springs.

In certain embodiments, the light module 114 includes a circuit board 124. In certain embodiments, the circuit board 124 can support one or more light sources 126. The one or more light sources 126 can be one or more light emitting diodes (LEDs), incandescent bulbs, fluorescent bulbs, halogen bulbs, or high intensity discharge bulbs. In embodiments, the circuit board 124 is configured so that the one or more light sources 126 are one or more LEDs that emit a single color such as white, red, green, or blue. In other embodiments, the one or more LEDs emit multiple colors such as by employing an array of controlled RGB LEDs. The one or more light sources 126 can be positioned or otherwise configured to emit light in one or more directions exterior to the light module 114.

In certain embodiments, the circuit board 124 includes a driver circuit for the one or more light sources 126. In certain embodiments, the circuit board 124 includes a temperature sensor. In certain embodiments, the circuit board 124 includes a microcontroller.

In certain embodiments, the light module 114 can include one or more contact pins 128. In certain embodiments, the light module 114 can include two, three, four, or any other suitable number of contact pins 128. In certain embodiments, the one or more contact pins 128 can be disposed such that when the light module 114 is inserted into the second opening 116 and transitions from the released position to the connected position, the one or more contact pins 128 electrically connect with the one or more contacts 122. In certain embodiments, the one or more contact pins 128 are disposed on the circuit board 124. In certain embodiments, the one or more contact pins 128 extend from the circuit board 124 along a longitudinal axis. In certain embodiments, the one or more contact pins 128 are soldered to the circuit board 124.

When the one or more contact pins 128 are electrically connected with the one or more contacts 122, electrical power can be supplied to the circuit board 124 through the contact block 118 and power wire 120 from the source of electrical power.

In certain embodiments, the light module 114 can include a window 130. In certain embodiments, the window 130 can be positioned to allow light from the one or more light sources 126 to project in at least one direction exterior to the light fixture assembly 110. In certain embodiments, the window 130 can be transparent or substantially transparent. In certain embodiments, the window 130 can be frosted. In certain embodiments, the window 130 may be tinted with a color. In certain embodiments, the window 130 may be tinted with a color to change the color temperature of the light emitting from the light fixture assembly 110.

In certain embodiments, the light module 114 can include a cover 132. In certain embodiments, the cover 132 can protect the circuit board 124 from the outside environment. In certain embodiments, the cover 132 comprises a cover portion 136 and a mating portion 138.

In certain embodiments, the light module 114 comprises a seal 140 configured to form a seal between the mating portion 138 and the opening 116. In certain embodiments, the seal 140 inhibits or prevents water or moisture ingress past the cover 132 and into the housing 112 when the light module 114 is in the connected position. In certain embodiments, the seal 140 is an O-ring.

In certain embodiments, the window 130 is disposed in the cover 132. In certain embodiments, the cover portion 136 includes the window 130. In certain embodiments, the cover 132 and the window 130 can be formed from different materials. In certain embodiments, the cover 132 and the window 130 can be formed from the same material. In certain embodiments, the cover 132 and the window 130 can be co-molded. In certain embodiments, the cover 132 and the window 130 can be insert molded. In certain embodiments, the cover 132 and the window 130 can be welded together. In certain embodiments, the cover 132 and the window 130 can be chemically bonded together.

In certain embodiments, the cover 132 comprises one or more supports 148. In certain embodiments, the one or more supports 148 limit movement of the circuit board 124 relative to the cover 132. The one or more supports 148 can confine or maintain the circuit board 124 in a position for facilitating installation of the light module 114 in the housing 112 by transitioning the light module 114 from the released position to the connected position. In certain embodiments, the circuit board 124 may fit loosely between two or more of the one or more supports 148. In certain embodiments, the circuit board 124 may fit snugly or closely between the one or more supports 148. In certain embodiments, the circuit board 124 may be releasably secured to the one or more supports 148 via a snap fit or press fit. In certain embodiments, the one or more supports 148 limit movement of the circuit board 124 relative to the cover 132 so that the light module 114 including the circuit board 124 and the cover 132 can be manipulated by a user as a single piece. For example, in certain embodiments, the light module 114 including the circuit board 124 and the cover 132 can be removed from the housing 112 as a single piece and/or inserted into the housing 112 as a single piece.

In certain embodiments, the cover 132 comprises one or more walls 149. In certain embodiments, the one or more walls 149 extend between two or more of the one or more supports 148.

In certain embodiments, the cover 132 comprises a post or alignment wall 152. In certain embodiments, the alignment wall 152 can align the circuit board 124 for assembly in the housing 112. In certain embodiments, the alignment wall 152 can include one or more recesses, protrusions, and/or other features positioned, sized, shaped, and/or otherwise configured to engage or guide a particular portion of the circuit board 124 to orient or align the circuit board in the housing 112. In certain embodiments, the alignment wall 152 can include one or more recesses, protrusions, and/or other features positioned, sized, shaped, and/or otherwise configured to prevent or inhibit movement of the circuit board 124 in at least one direction when the circuit board 124 is engaged with the alignment wall 152.

In certain embodiments, the one or more light sources 126 can be arranged relative to the circuit board 124 to emit light in a direction towards the opening 116 of the housing 112 and through the window 130 when the module 114 is in the connected position. In certain embodiments, the one or more light sources 126 can receive electrical power through the circuit board 124 when the one or more contact pins 128 of the circuit board 124 are electrically connected to the one or more contacts 122.

In certain embodiments, the circuit board 124 can receive a data encoded power signal. In certain embodiments, the one or more light sources 126 can be dimmable. In certain embodiments, the light source 126 can be color changing. In certain embodiments, the one or more light sources 126 can be operated by a switch, a remote control, or any other suitable controller. In some embodiments, the light source 126 can be operated by a lighting controller as disclosed in U.S. Pat. No. 9,295,170 issued Mar. 22, 2016, a circuit board and controller that can control at least one of dimming, zoning, and lighting as disclosed in U.S. Pat. No. 9,521,725 issued Dec. 13, 2016, and U.S. patent application publication No. 2017/0127493 filed Jan. 12, 2017. All of which list Woytowitz as an inventor and are assigned to Hunter Industries, Inc., the assignee of the current application.

In certain embodiments, the light fixture assembly 110 includes one or more fasteners 142 configured to releasably secure the light module 114 to the housing 112. In certain embodiments, the light module includes one or more apertures 144 configured to receive the fasteners 142. In certain embodiments, the housing 112 includes one or more fastener recesses 146. In certain embodiments, each fastener recess 146 aligns with one of the apertures 144 of the light module 114 when the light module 114 is in the connected position. In certain embodiments, the light module 114 is configured to be removable from the housing 112 by hand after the one or more fasteners 142 are removed from the fastener recesses 146. In certain embodiments, each fastener recess 146 may be positioned in an interior portion of a protrusion 145 extending from an internal surface, such as a rear surface, of the receptacle 115. In certain embodiments, the fastener recess 146 can be threaded to receive a threaded portion of the fastener 142. In certain embodiments, the circuit board 124 can comprise one or more apertures 125. The apertures 125 can be configured to receive the protrusions 145, respectively, when the light module 114 is in the connected position. In certain embodiments, the protrusion 145 and corresponding aperture 125 acts to align the light module 114 within the housing 112 when the light module 114 is being transitioned to the connected position.

In certain embodiments, the light fixture assembly 110 can include one or more seals 143. The seals 143 can be positioned between heads of the fasteners 142 and the cover 132. In certain embodiments, the seals 143 can prevent or inhibit water or moisture ingress between the fasteners 142 and the cover 132 and into the light module 114. In certain embodiments the seals 143 can be O-rings.

Figure 3:
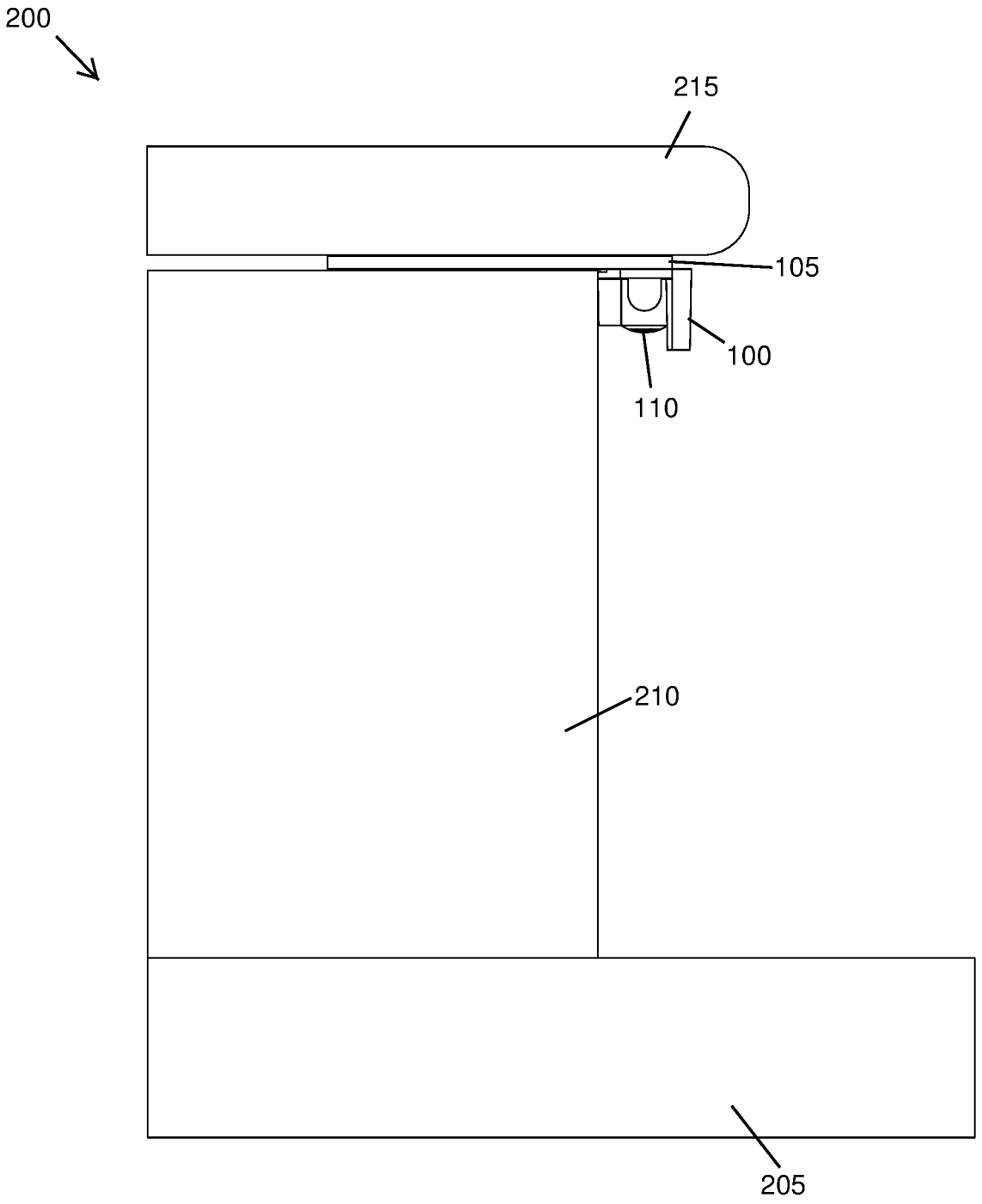
FIG. 3 is a side view of a light installation including the light assembly of FIG. 1.

FIG. 3 illustrates an example of a light installation 200 including the light assembly 100. As shown in the example of FIG. 3, the light installation 200 can include a base 205, a riser 210, and a cap 215. The base 205, the riser 210, and the cap 215 may be part of a step, a stair, a wall, or any other suitable structure.

The base 205 can be a ground surface, a floor surface, a platform, or any other suitable surface. In certain embodiments, the base 205 can be formed of concrete. In certain embodiments, the base 205 can be formed of soil. In certain embodiments, the base 205 can provide structural support to the riser 210 and/or cap 215.

The riser 210 can be positioned superior to the base 205. In certain embodiments, the riser 210 can be rest on a top surface of base 205. In certain embodiments, the riser 210 can extend superiorly from the base 205 towards the cap 215. In certain embodiments, the riser 210 can be structurally supported by the base 205. In certain embodiments, the riser 210 can be formed of concrete, cinder block, brick, wood, plastic, or any other suitable material. In certain embodiments, the riser 210 can provide structural support to the cap 215.

The cap 215 can be positioned superior to the riser 210. In certain embodiments, the cap 215 can rest on a top surface of the riser 210. In certain embodiments, the cap 210 car be structurally supported by the base 205. In certain embodiments, the cap 215 can extend laterally beyond at least one edge of the riser 210. In certain embodiments, the cap 215 can be formed of stone, brick, concrete, wood, composite, or any other suitable material.

In certain embodiments, at least a portion of the light assembly 100 can be installed between the riser 210 and the cap 215. In certain embodiments, the mounting plate 105 can be installed between the riser 210 and the cap 215 to secure the light assembly 100 within the installation 200.

In certain embodiments, the mounting plate 105 can be embedded into a layer of mortar between the riser 210 and the cap 215. For example, in certain embodiments in which the riser 210 and the cap 215 are formed of stone, brick, or concrete, the mounting plate 105 can be embedded into a layer of mortar or adhesive between the riser 210 and the cap 215. In certain embodiments, the mounting plate 105 can be embedded into a layer between the riser 210 and the cap 215 to secure the light assembly 100 within the installation 200.

In certain embodiments, the mounting plate 105 can be fastened to a surface of the riser 210. For example, in embodiments in which the riser 210 and cap 215 are formed of wood, such as wooden stairs, the mounting plate 105 can be fastened to a surface of the riser 210. In certain embodiments, the mounting plate 105 can be fastened to a surface of the riser 210 to secure the light assembly 100 within the installation 200. After the mounting plate 105 is fastened to the riser 210, the cap 215 can be installed over a top surface of the mounting plate 105.

In certain embodiments, a mounting plate 105 is not used. In certain embodiments, the light fixture assembly 110 is secured below the cap 215. For example, in embodiments in which the riser 210 and cap 215 are formed of wood, such as wooden stairs, the light fixture assembly 110 is secured to the lower side of the cap 215 in front of the riser 210. In certain embodiments, the light fixture assembly 110 is fastened to the cap 215 by one or more fasteners through the apertures 111 depicted in FIG. 2. For example, in embodiments in which the riser 210 and the cap 215 are formed of wood, such as wooden stairs, the light fixture assembly 110 is fastened to the cap 215 by one or more fasteners through the apertures 111. The fasteners can be screws, bolts, nuts, or any other suitable fastener.

In certain embodiments, the mounting plate 105 may be mounted to attach the light fixture assembly 110 to a face of the riser 210. In some embodiments, the mounting plate 105 may have an L-shape to facilitate mounting of the light fixture assembly 110 to the face of the riser 210.

Figure 4:
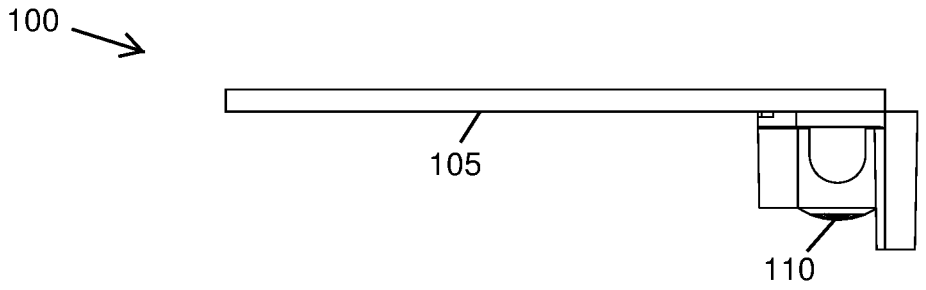
FIG. 4 is a side view of the light assembly of FIG. 1.
Figure 5:
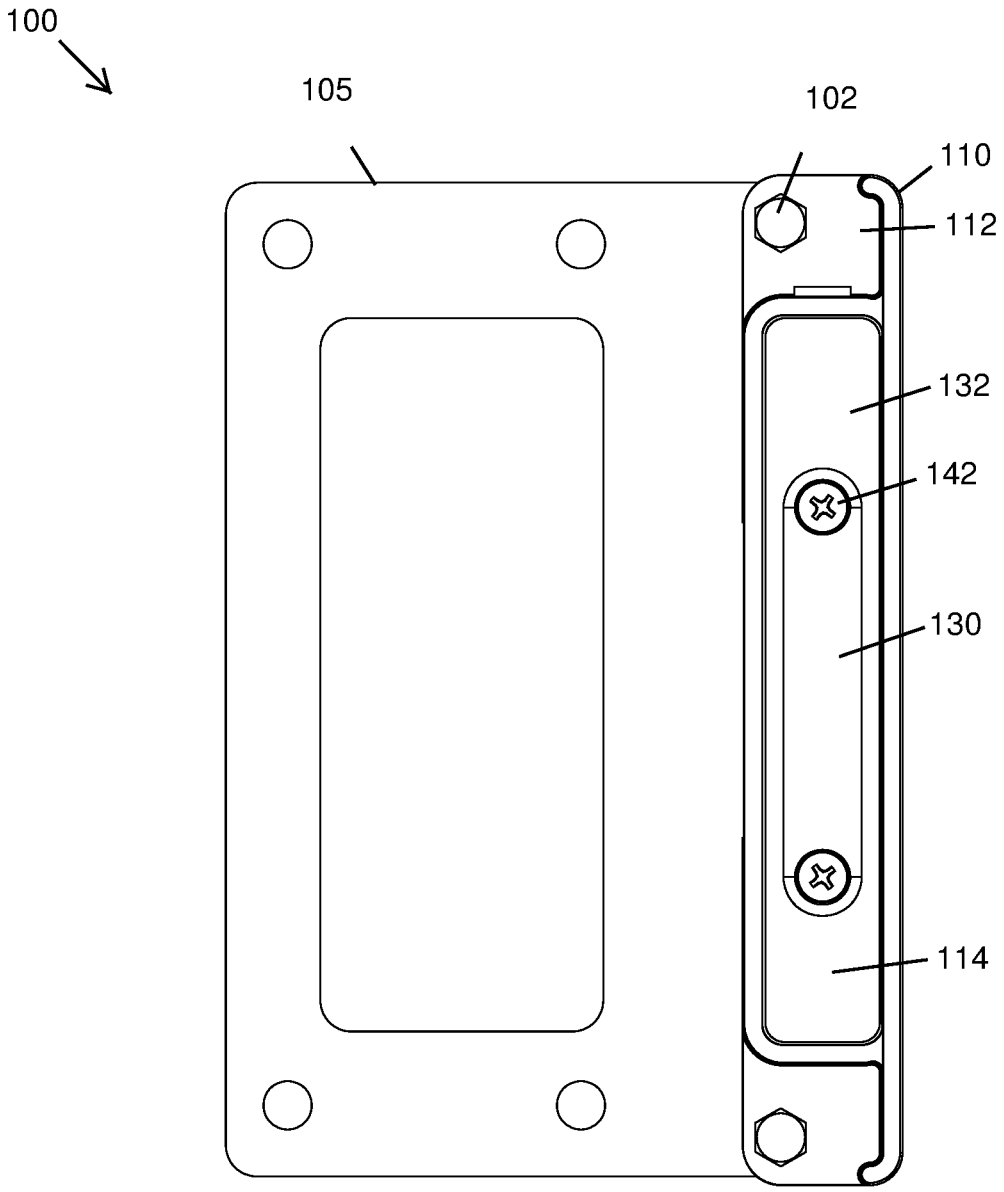
FIG. 5 is a bottom view of the light assembly of FIG. 1.

FIG. 4 illustrates a side view of the light assembly 100. FIG. 5 illustrates a bottom view of the light assembly 100.

Figure 6:
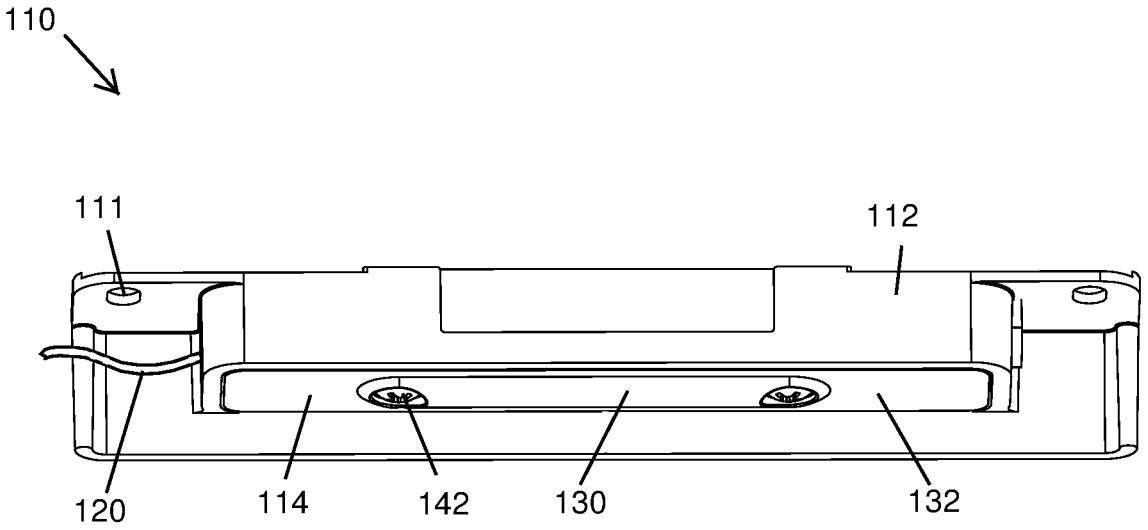
FIG. 6 is a bottom perspective view of a light fixture assembly of the light assembly of FIG. 1.

FIG. 6 illustrates a bottom perspective view of the light fixture assembly 110 with the light module 114 in the connected position. As described herein, the apertures 111 can facilitate fastening of the light fixture assembly 110 to the mounting plate 105 or to the cap 215. In certain embodiments, the apertures 111 can be used to fasten the light fixture assembly 110 to a bottom surface of a stair tread.

Figure 7:
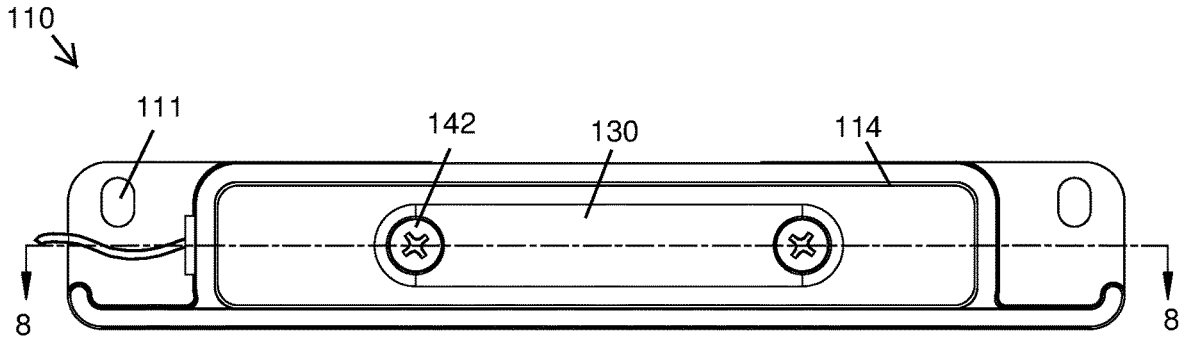
FIG. 7 is a bottom view of the light fixture assembly of FIG. 6.
Figure 8:
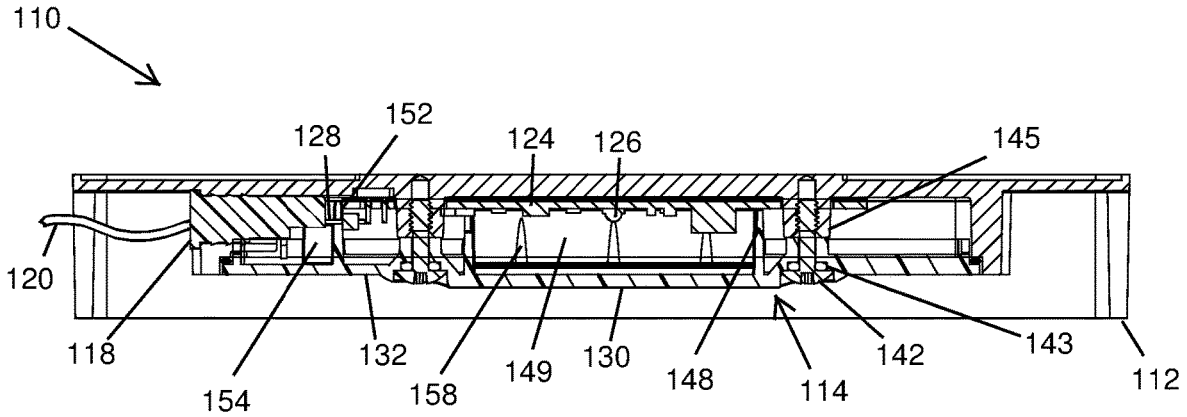
FIG. 8 is a cross-sectional view of the light fixture assembly of FIG. 6 taken along line 8-8 as depicted in FIG. 7.

FIG. 7 illustrates a bottom view of the light fixture assembly 110 with the light module 114 in the connected position. FIG. 8 illustrates a cross-sectional view of the light fixture assembly 110 with the light module 114 in the connected position taken along line 8-8 as depicted in FIG. 7. As shown in FIG. 8, the cover 132 can include a contact pin support 154. In certain embodiments, the contact pin support 154 can provide support to the one or more contact pins 128 while the light module 114 is transitioning to or in the connected position. In certain embodiments, the contact pin support 154 can provide support to the one or more contact pins 128 when the light module 114 is in the released position. In certain embodiments, the contact pin support 154 can provide support to the one or more contact pins 128 during at least a portion of a period of time when the light module 114 is transitioning between the released position and the connected position. In certain embodiments, the contact pin support 154 can support the one or more contact pins 128 by preventing or inhibit flexing of the one or more contact pins 128 when the light module 114 is in the connected position or during at least a portion of a period of time when the light module 114 is transitioning from the released position to the connected position.

In certain embodiments, the contact pin support 154 can support the one or more contact pins 128 so that the one or more contact pins 128 maintain positive contact with the one or more contacts 122 (FIGS. 2A, 2B) of the contact block 118 when the light module 114 is in the connected position. In certain embodiments, the contact pin support 154 can support the one or more contact pins 128 by maintaining positive contact with the one or more contacts 122 of the contact block 118 during at least a portion of a period of time when the light module 114 is transitioning from the released position to the connected position. In certain embodiments, the pin support 154 can provide support to the one or more contact pins 128 by limiting movement of the one or more contact pins 128 in a direction away from the one or more contacts 122 when the light module 114 is in the connected position. In certain embodiments, the pin support 154 can provide support to the one or more contact pins 128 by limiting movement of the one or more contact pins 128 in a direction away from the one or more contacts 122 during at least a portion of a period of time when the light module 114 is transitioning from the released position to the connected position.

Figure 9:
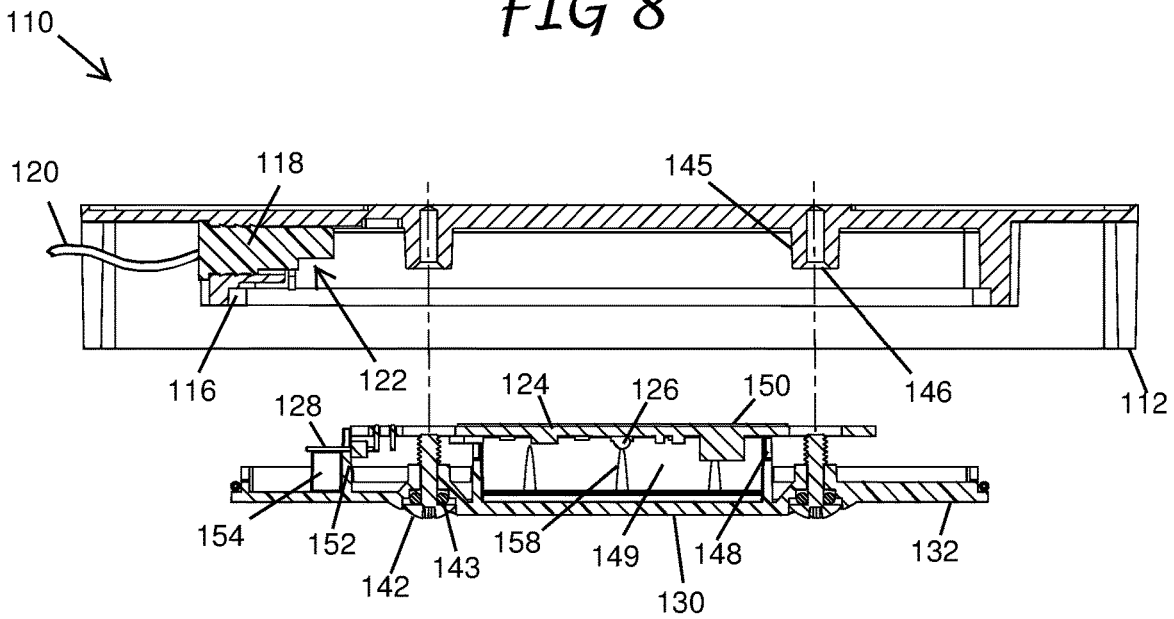
FIG. 9 is an exploded cross-sectional view of the light fixture assembly of FIG. 6 taken along line 8-8 as depicted in FIG. 7.

FIG. 9 depicts an exploded cross-sectional view of the light fixture assembly 110 taken along line 8-8 as depicted in FIG. 7. FIG. 9 shows the light module 114 in the released position. As shown in FIG. 9, the fasteners 142 are released from the housing 112 and an entirety of the light module 114 is accessible to a user. As shown in FIG. 9, in certain embodiments, the fasteners 142 are captive fasteners. In embodiments in which the fasteners 142 are captive fasteners, the fasteners 142 may be held captive in the cover 132. The captive fasteners may reduce the risk of losing the fasteners 142 in areas adjacent to the light assembly 100.

As shown in FIG. 9, when the light module 114 is in the released position, the light module 114 is disengaged from the power wire 120. When the light module 114 is in the released position, the light module 114 can be serviced by a user without concerns regarding the connection to the power wire 120.

In certain embodiments, the light module 114 can be transitioned from the released position to the connected position by inserting the light module 114 into the opening 116 and contacting the one or more contact pins 128 with the one or more contacts 122. In certain embodiments, the light module 114 can be transitioned from the released position to the connected position by transitioning the one or more contact pins 128 from a non-electrically connected state to an electrically connected state with the one or more contacts 122. In certain embodiments, the one or more contact pins 128 can be transitioned from a non-electrically connected state to an electrically connected state with the one or more contacts 122 (FIGS. 2A, 2B) by movement of the one or more contact pins 128 in a direction that is perpendicular to a longitudinal axis of the one or more contact pins 128.

In certain embodiments, when the light module 114 is transitioned from the released position to the connected position, the one or more contact pins 128 make electrical contacts with the one or more contacts 122. As described herein, in certain embodiments, the one or more contacts 122 can be spring contacts. In certain embodiments, as the light module 114 is transitioned from the released position to the connected position, the contact pins 128 compress the one or more contacts 122 in the contact block 118 to create an electrical connection between the contact block 118 and the circuit board 124.

In certain embodiments, the cover 132 can transition between a secured position and an unsecured position relative to the housing 112. In certain embodiments, the cover 132 is spaced further from the opening 116 of the housing 112 in the unsecured position than when in the secured position. In certain embodiments, the light module 114 transitions between the connected position and the unconnected position by transition of the cover 132 between the secured position and the unsecured position. In certain embodiments, the cover 132 transitions from the unsecured position to the secured position by placement of the cover 132 against the housing 112. In certain embodiments, the cover 132 transitions from the unsecured position to the secured position by fastening of the fasteners 142 within the fastener recesses 146.

In certain embodiments, the pin support 154 is disposed so as to limit movement of the one or more contact pins 128 in a direction away from the one or more contacts 122 and relative to the circuit board 124 by contacting the one or more contact pins 128 when the cover 132 is moved from the unsecured position to the secured position by bringing the one or more contact pins 128 into electrical contact with the one or more contacts 122. In certain embodiments, the pin support 154 is disposed so as to contact the one or more contact pins 128 during at least a portion of a period of time when the cover 132 is moved from the unsecured position to the secured position and the one or more contact pins 128 transition from the non-electrically connected state to the electrically connected state.

As shown in FIG. 9, in certain embodiments, the light module 114 comprises one or more thermal pads 150. In certain embodiments, the one or more thermally conductive pads or thermal pads 150 are positioned on the light module 114. In certain embodiments, the one or more thermal pads 150 are configured to transfer heat from the light module 114 to the housing 112. In certain embodiments, the thermal pads 150 are positioned to contact a portion of the housing 112 when the light module 114 is in the connected position. In certain embodiments, the one or more thermal pads 150 may act as heat sinks. In certain embodiments, transition of the light module 114 to the connected position from the released position compresses the one or more thermal pads 150. In certain embodiments, the one or more thermal pads 150 may have increased heat conduction properties when compressed.

Figure 10:
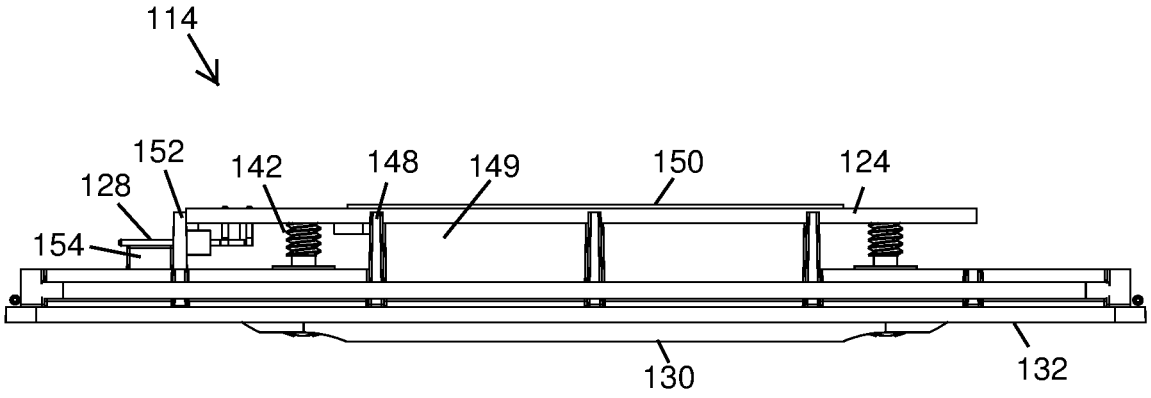
FIG. 10 is a side view of a light module of the light fixture assembly of FIG. 6.

FIG. 10 illustrates a side view of the light module 114. As described above, the one or more supports 148 can limit movement of the circuit board 124 relative to the cover 132. For example, the one or more supports 148 of the light module 114 can confine or maintain the circuit board 124 in a location for facilitating installation of the light module 114 in the housing 112 when the light module 114 moves from the released position to the connected position. In certain embodiments, the circuit board 124 may fit loosely between the one or more supports 148. In certain embodiments, the circuit board 124 may fit snugly or closely between the one or more supports 148. In certain embodiments, the circuit board may engage the one or more supports 148 via a snap fit or press fit. In certain embodiments, the one or more supports 148 may limit movement of the circuit board 124 relative to the cover 132 so that the light module 114 including the circuit board 124 and the cover 132 can be removed from the housing 112 as a single piece and/or inserted into the housing 112 as a single piece.

After removal of the light module 114 from the housing 112 as a single piece, one or more of the components of the light module 114 may be disassembled. For example, in certain embodiments, after removal of the light module 114 from the housing 112, the circuit board 124 can be disengaged from the cover 132.

Figure 11:
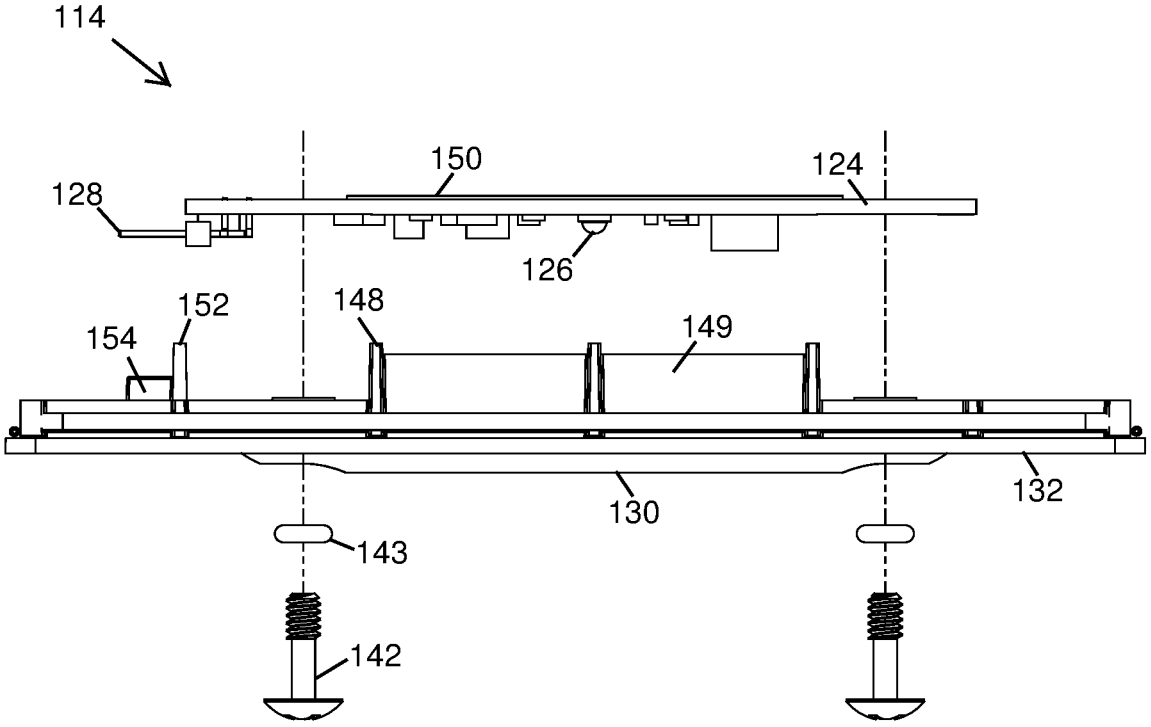
FIG. 11 is an exploded side view of the light module of FIG. 10.
Figure 12:
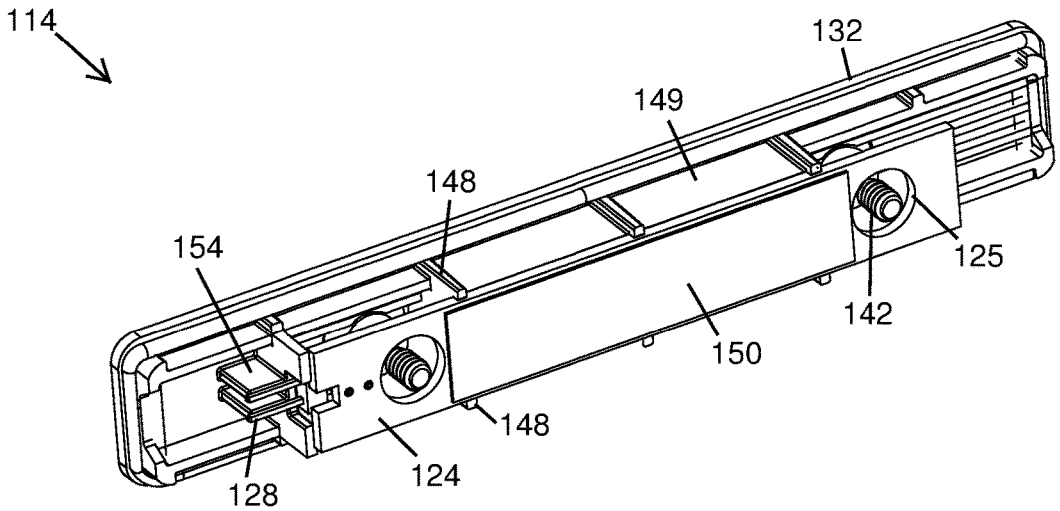
FIG. 12 is a top perspective view of the light module of FIG. 10.
Figure 13:
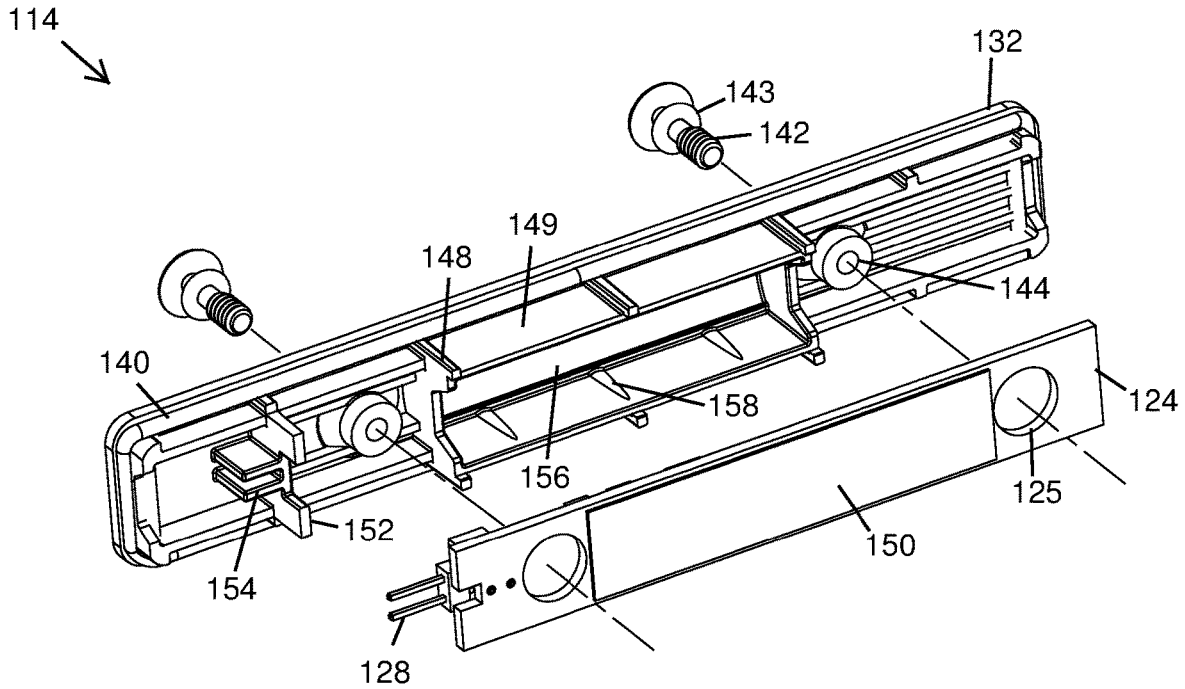
FIG. 13 is an exploded perspective view of the light module of FIG. 10.

FIG. 11 illustrates an exploded side view of the light module 114. FIG. 11 shows the circuit board 124 disengaged from the cover 132. FIG. 12 illustrates a top perspective view of the light module 114. FIG. 13 illustrates an exploded perspective view of the light module 114. As shown in FIG. 13, the cover 132 can include a cavity 156. In certain embodiments, the cavity 156 can be formed by the one or more supports 148 and the walls 149. In certain embodiments, the cavity 156 can include one or more surface features 158. The surface features 158 can be configured to engage and/or secure components positioned within the cavity 156. In certain embodiments, the surface features 158 can be ribs, ridges, protrusions, grooves, slots, recesses, or any other suitable surface features. In certain embodiments, the one or more one or more surface features 158 can extend into the interior of the cavity 156 from the walls 149.

Figure 14:
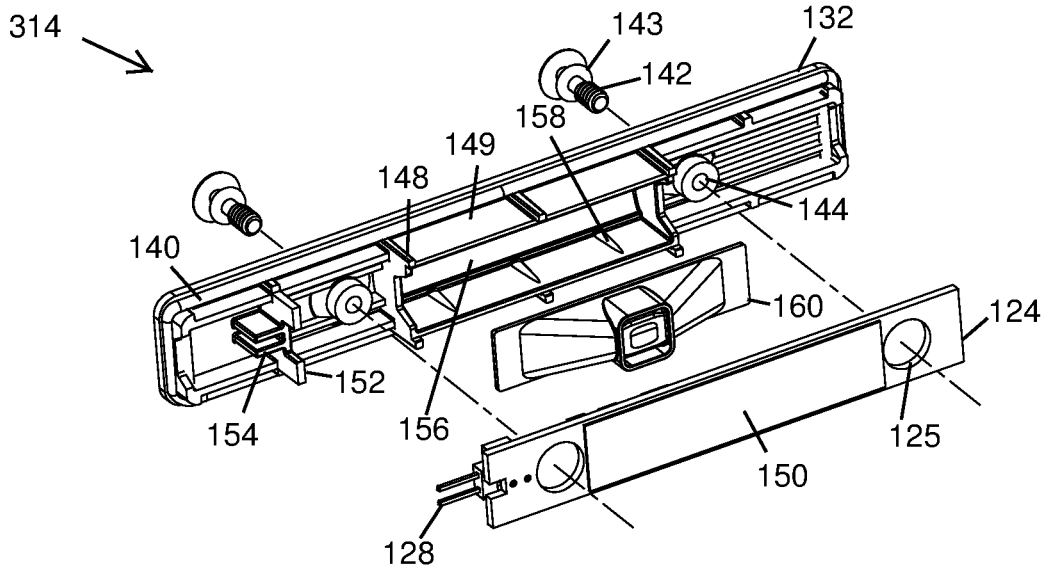
FIG. 14 is an exploded perspective view of a light module according to another preferred embodiment of the present invention.

FIG. 14 illustrates an embodiment of a light module 314. The light module 314 can include any of the same or similar features and functions as the light module 114. For example, the light module 314 can be used in certain embodiments of the light fixture assembly 110. As shown in FIG. 14, the one or more individual components of the light module 314 can include a reflector 160. In certain embodiments, the reflector 160 can be positioned between the window 130 and the circuit board 124. In certain embodiments, the reflector 160 can intensify, distribute and/or otherwise focus light emitted from the one or more light sources 126. In certain embodiments, the reflector 160 can be releasably secured between the one or more supports 148 via a press fit or snap fit. In certain embodiments, the reflector 160 can be loosely positioned within the cover 132. In certain embodiments, the reflector 160 can be secured within the cavity 156 formed on the cover 132. In certain embodiments, the reflector 160 can be secured within the cavity 156 by a press fit or snap fit. In certain embodiments, the reflector 160 can be snugly or closely fit to surface features 158. In certain embodiments, the reflector 160 can be releasably secured between the surface features 158 by a press fit or snap fit. In certain embodiments, the surface features 158 can be positioned, sized, shaped, and/or otherwise configured to maintain the reflector in a defined position relative to the window 130.

In certain embodiments, the light module 314 including the circuit board 124 and the cover 132 can be removed from the housing 112 as a single piece and/or inserted into the housing 112 as a single piece.

After removal of the light module 314 from the housing 112 as a single piece, one or more of the components of the light module 314 may be disassembled. For example, in certain embodiments, after removal of the light module 114 from the housing 112, the circuit board 124 can be disengaged from the cover 132. In certain embodiments, after removal of the light module 314 from the housing 112, one or more of the cover 132, the circuit board 124, and the reflector 160 can be removed or replaced.

Figure 15:
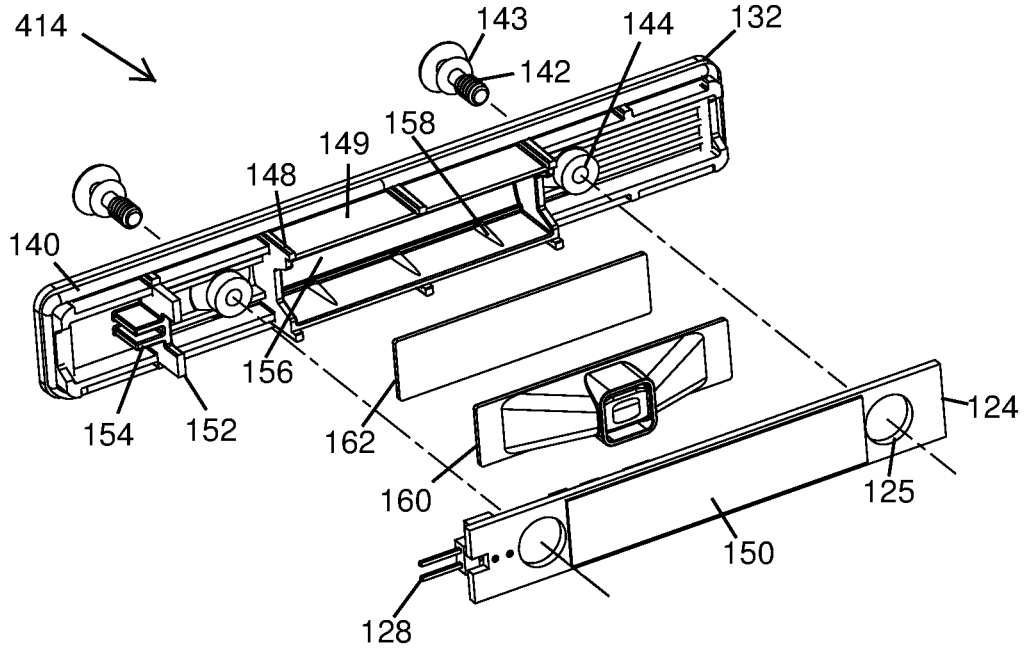
FIG. 15 is an exploded perspective view of a light module according to another preferred embodiment of the present invention.

FIG. 15 illustrates an embodiment of a light module 414. The light module 414 can include any of the same or similar features and functions as the light modules 114 and 314. For example, the light module 414 can be used in certain embodiments of the light fixture assembly 110. As shown in FIG. 15, the one or more individual components of the light module 414 can include a diffuser 162. The diffuser 162 can be positioned between the window 130 and the circuit board 124. In certain embodiments, the diffuser 162 can direct light in one or more defined directions. In certain embodiments, the diffuser 162 can spread light in more even distribution to an intended surface than a light module without the diffuser 162.

In certain embodiments, the diffuser 162 can be positioned, shaped, sized, or otherwise formed to enhance the quality of the light fixture assembly 110. In certain embodiments, the diffuser 162 can be loosely positioned within the cover 132. In certain embodiments, the diffuser 162 can be secured within the cavity 156. In certain embodiments, the diffuser 162 can be secured within the cavity 156 by a press fit or snap fit. In certain embodiments, the diffuser 162 can be snugly or closely fit to the surface features 158. In certain embodiments, the diffuser 162 can be releasably secured to the surface features 158 by a press fit or snap fit. In certain embodiments, the surface features 158 can be positioned, sized, shaped, and/or otherwise configured to maintain the diffuser 162 in a defined position relative to the window 130.

As illustrated in FIG. 15, in certain embodiments, the one or more individual components of the light module 414 includes the reflector 160. In other embodiments, the light module 414 does not include the reflector 160. In certain embodiments, the light module 414 may include a plurality of diffusers 162.

After removal of the light module 414 from the housing 112 as a single piece, one or more of the components of the light module 414 may be disassembled by the user to service the light module 414. For example, in certain embodiments, after removal of the light module 414 from the housing 112, the circuit board 124 can be disengaged from the cover 132. In certain embodiments, after removal of the light module 414 from the housing 112, one or more of the cover 132, the circuit board 124, the reflector 160, and the diffuser 162 can be removed or replaced.

Figure 16:
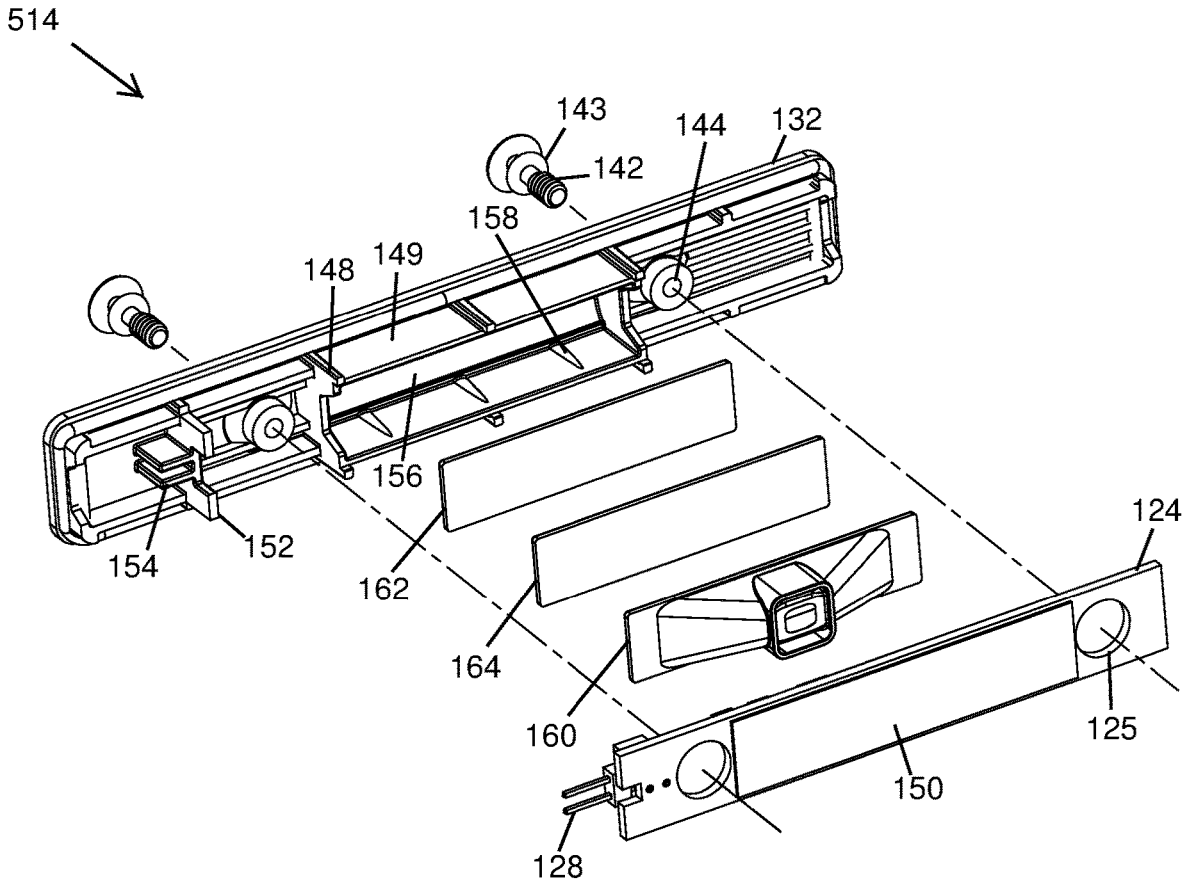
FIG. 16 is an exploded perspective view of a light module according to another preferred embodiment of the present invention.

FIG. 16 illustrates an embodiment of a light module 514. The light module 514 can include any of the same or similar features and functions as the light modules 114, 314, and 414. For example, the light module 514 can be used in certain embodiments of the light fixture assembly 110. As shown in FIG. 16, the one or more individual components of the light module 414 can include a filter 164. The filter 164 can be positioned between the window 130 and the circuit board 124. In certain embodiments, the filter 164 can be positioned, shaped, sized, or otherwise formed to enhance the quality of the light fixture assembly 110. In certain embodiments, the filter 164 can be loosely positioned within the cover 132. In certain embodiments, the filter 164 can be secured within the cavity 156. In certain embodiments, the filter 164 can be secured within the cavity 156 by a press fit or snap fit. In certain embodiments, the filter 164 can be snugly or closely fit to the surface features 158. In certain embodiments, the filter 164 can be releasably secured to the surface features 158 by a press fit or snap fit. In certain embodiments, the surface features 158 can be positioned, sized, shaped, and/or otherwise configured to maintain the filter 164 in a defined position relative to the window 130.

In certain embodiments, the filter 164 can include a textured surface. In certain embodiments, the filter 164 can include a textured surface textured or otherwise configured to disperse light in a more even distribution from the one or more light sources 126 towards the window 130. In certain embodiments, the filter 164 may be transparent or substantially transparent. In certain embodiments, the filter 164 may be translucent or semitransparent. In certain embodiments, the filter 164 can be colored. In certain embodiments, the filter 164 can be colored to modify the color of light emitting from the light fixture assembly 110.

As illustrated in FIG. 16, in certain embodiments, the light module 514 can include the reflector 160, the diffuser 162, and the filter 164. In other embodiments, the light module 514 does not include one or more of the reflector 160, the diffuser 162, and the filter 164. In certain embodiments, the light module 514 may include a plurality of diffusers 162 or filters 164.

After removal of the light module 514 from the housing 112 as a single piece, one or more of the components of the light module 514 may be disassembled. For example, in certain embodiments, after removal of the light module 514 from the housing 112, the circuit board 124 can be disengaged from the cover 132. In certain embodiments, after removal of the light module 514 from the housing 112, one or more of the cover 132, the circuit board 124, the reflector 160, the diffuser 162, and the filter 164 can be removed or replaced.

While the above detailed description has shown, described, and pointed out novel features of the development as applied to various embodiments, it will be understood that various omissions, substitutions, and changes in the form and details of the devices illustrated may be made by those skilled in the art without departing from the spirit of the development. As will be recognized, the present development may be embodied within a form that does not provide all of the features and benefits set forth herein, as some features may be used or practiced separately from others. All changes which come within the meaning and range of equivalency of the claims are to be embraced within their scope.

The foregoing description details certain embodiments of the systems, devices, and methods disclosed herein. It will be appreciated, however, that no matter how detailed the foregoing appears in text, the systems, devices, and methods may be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment may be included with other depicted embodiments in any combination. For example, any of the various components described herein and/or depicted in the Figures may be combined, interchanged or excluded from other embodiments.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The term "comprising" as used herein is synonymous with "including," "containing," or "characterized by," and is inclusive or open-ended and does not exclude additional, unrecited elements or method steps.

The above description discloses several methods of manufacture and materials of the present development. This development is susceptible to modifications in the methods and materials, as well as alterations in the fabrication methods and equipment. Such modifications will become apparent to those skilled in the art from a consideration of this disclosure or practice of the development disclosed herein. Consequently, it is not intended that this development be limited to the specific embodiments disclosed herein, but that it cover all modifications and alternatives coming within the true scope and spirit of the development as embodied in the attached claims.

While the above detailed description has shown, described, and pointed out novel features of the improvements as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others. The scope of the invention is indicated by the appended claims rather than by the foregoing description. All changes which come within the meaning and range of equivalency of the claims are to be embraced within their scope.

What is claimed is:

1. An outdoor light fixture assembly configured to be supported by a step or cap via a mounting plate, the outdoor light fixture assembly comprising:

a housing configured to be support by the mounting plate, the housing forming a receptacle having at least a first opening and a second opening, the second opening having an outer perimeter;

a contact block having at least one contact and a power wire, the contact block being sized and shaped to be disposed relative to the first opening such that the at least one contact is accessible from inside the housing and at least a portion of the power wire is disposed outside the housing, the power wire being configured to releasably and electrically connect with a source of electric power; and a user serviceable light module being sized and shaped to transition between a connected position and a released position relative to the housing and allowing a user to disassemble the user serviceable light module and service individual components, the user serviceable light module being disposed in the receptacle and covering the second opening so as to prevent water from entering the housing through the second opening, the user serviceable light module having a cover and a circuit board supporting one or more light emitting diodes, the cover having a mating portion sized and shaped to contact the outer perimeter of the second opening, the circuit board having at least one contact pin, the one or more light emitting diodes being arranged relative to the circuit board to emit light in a direction towards the second opening of the housing.

2. The outdoor light fixture assembly of claim 1, wherein the at least one contact pin electrically connects with the at least one contact.

3. The outdoor light fixture assembly of claim 1, wherein the user serviceable light module is configured to transition between the connected and released positions without the use of tools.

4. The outdoor light fixture assembly of claim 1, wherein the cover comprises a window.

5. The outdoor light fixture assembly of claim 4, wherein the user serviceable light module further comprises at least one seal disposed between the second opening and the cover.

6. The outdoor light fixture assembly of claim 5, wherein the cover comprises a cover portion having the window, the mating portion having the at least one seal configured to form a seal between the mating portion and the outer perimeter of the second opening, and wherein the at least one seal inhibits or prevents moisture ingress past the cover and into the housing.

7. The outdoor light fixture assembly of claim 1, wherein the user serviceable light module further comprises one or more filters.

8. The outdoor light fixture assembly of claim 1, wherein the user serviceable light module further comprises one or more diffusers.

9. The outdoor light fixture assembly of claim 1, wherein the user serviceable light module further comprises one or more reflectors.

10. The outdoor light fixture assembly of claim 1, wherein the circuit board further comprises a driver circuit for the one or more light emitting diodes.

11. The outdoor light fixture assembly of claim 1, wherein the circuit board further comprises a temperature sensor.

12. The outdoor light fixture assembly of claim 1, wherein the circuit board further comprises a microcontroller.

13. The outdoor light fixture assembly of claim 1, wherein the at least one contact pin is disposed on the circuit board.

14. The outdoor light fixture assembly of claim 1, wherein the at least one contact is a spring contact.

15. The outdoor light fixture assembly of claim 14, wherein the spring contact is a coiled wire.

16. The outdoor light fixture assembly of claim 14, wherein the spring contact is a leaf spring.

17. The outdoor light fixture assembly of claim 1, further comprising at least one fastener configured to releasably secure the outdoor light fixture assembly to the mounting plate.

18. The outdoor light fixture assembly of claim 1, further comprising at least one fastener configured to releasably secure the user serviceable light module to the housing.

19. The outdoor light fixture assembly of claim 18, wherein the user serviceable light module includes an aperture configured to receive the at least one fastener, wherein the housing includes a fastener recess aligned with the aperture of the user serviceable light module, and wherein the user serviceable light module is configured to be removable from the housing by hand after the at least one fastener is removed from the fastener recess.

20. The outdoor light fixture assembly of claim 1, wherein the contact block is configured to transfer power from the power wire to the user serviceable light module.

21. The outdoor light fixture assembly of claim 1, further comprising one or more thermal pads positioned on the user serviceable light module and configured to transfer heat from the user serviceable light module to the housing.

22. The outdoor light fixture assembly of claim 21, wherein transition of the user serviceable light module to the connected position compresses the one or more thermal pads, and the one or more thermal pads have increased heat conduction properties.

23. An outdoor light fixture assembly comprising:

a housing forming a receptacle having at least a first opening and a second opening, the second opening having an outer perimeter; a contact block having at least one contact and a power wire, the contact block being sized and shaped to be disposed in the first opening such that the at least one contact is accessible from inside the housing and at least a portion of the power wire is disposed outside the housing, the power wire being configured to releasably and electrically connect with a source of electric power; a circuit board disposed in the receptacle supporting one or more light emitting diodes and having at least one contact pin; and a cover being sized and shaped to transition between a secured position and an unsecured position relative to the housing, the cover being disposed on the receptacle and includes a mating portion sized and shaped to cover the outer perimeter of the second opening so as to prevent water from entering the housing through the second opening when in the secured position, the cover being spaced further from the second opening when in the unsecured position than when in the secured position, the cover having a contact support disposed so as to limit movement of the at least one contact pin in a direction away from the at least one contact and relative to the circuit board by contacting the at least one contact pin when the cover is moved from the unsecured position to the secured position bringing the at least one contact pin into electrical contact with the at least one contact.

24. The outdoor light fixture assembly of claim 23, wherein the cover transitions from the unsecured position to the secured position by placement of the cover against the housing.

25. The outdoor light fixture assembly of claim 23, wherein the cover transitions from the unsecured position to the secured position by a user employing a fastener.

26. The outdoor light fixture assembly of claim 23, wherein the cover further comprises one or more supports configured to limit movement of the circuit board relative to the cover and allow a user to remove the cover and the circuit board as one piece from the housing.

27. An outdoor light fixture assembly comprising: a housing forming a receptacle having at least a first opening and a second opening, the second opening having an outer perimeter; a cover having a mating portion sized and shaped to contact the outer perimeter of the second opening;

a contact block having at least one contact disposed in the receptacle; and a circuit board disposed in the receptacle and having at least one contact pin, the at least one contact pin extending from the circuit board and along a longitudinal axis of the at least one contact pin, the at least one contact pin transitioning from a non-electrically connected state to an electrically connected state with the at least one contact by movement of the at least one contact pin in a direction that is perpendicular to the longitudinal axis.

28. The outdoor light fixture assembly of claim 27, wherein the cover has one or more supports configured to limit movement of the circuit board relative to the cover and allow a user to remove the cover and the circuit board as a user serviceable module from the housing.

29. The outdoor light fixture assembly of claim 27, wherein the cover is sized secured position and an unsecured position relative to the housing, the cover having a pin support disposed so as to contact the at least one contact pin during at least a portion of a period of time when the cover is moved from the unsecured position to the secured position and the at least one contact pin transitions to the electrically connected state.

* * * * *